US006067944A

United States Patent [19]

Blue et al.

[11] Patent Number: 6,067,944

[45] Date of Patent: May 30, 2000

[54] FURNACE FLOOR

[75] Inventors: Jerry D. Blue, Clinton; James D. Fleming, Canton, both of Ohio

[73] Assignee: The Babcock & Wilcox Company, New Orleans, La.

[21] Appl. No.: 09/292,722

[22] Filed: Apr. 15, 1999

[51] Int. Cl.[7] ..... F22B 15/00

[52] U.S. Cl. ..... 122/235.25; 122/235.12; 122/235.15; 122/235.22

[58] Field of Search ..... 122/235.11, 235.12, 122/235.14, 235.15, 235.22, 235.25

*Primary Examiner*—Teresa Walberg
*Assistant Examiner*—Jiping Lu
*Attorney, Agent, or Firm*—Robert J. Edwards; Eric Marich

[57] ABSTRACT

An improved floor for a recovery boiler furnace having a flat floor has a number of tubes in the floor immediately adjacent each of the sidewalls of the furnace oriented at an oblique angle to horizontal. A method of replacing the floor is provided as well.

9 Claims, 3 Drawing Sheets

FURNACE FLOOR

FIELD OF THE INVENTION

The present invention relates generally to the field of industrial furnaces and boilers and, more particularly, to an improved decanting floor design for kraft recovery boilers.

BACKGROUND OF THE INVENTION

Kraft recovery boilers are used in the pulp and paper industry to recover usable energy from byproducts of the pulp making process. Kraft recovery boilers are similar to conventional fossil-fuel fired boilers. Black liquor fuel is introduced into the furnace along with combustion air. Inside the furnace, residual water is evaporated from the black liquor, and the organic material from the black liquor is combusted. The inorganic portions of the black liquor are recovered as sodium/sulfur compounds.

Gases genera,ed by the black liquor combustion rise out of the furnace and flow across convection heat transfer surfaces. The vertical enclosure walls of the furnace are formed from heat transfer surfaces made of interconnected water tubes. Typically, feedwater enters the recovery boiler at the bottom of a first pass economizer, in which the water is heated as it flows to a steam drum. Saturated water is routed from the steam drum through pipe downcomers to lower furnace enclosure wall and floor inlet headers and a boiler bank. Natural circulation flow in the tubes is induced and driven by heat input to the vertical water cooled enclosure walls of the furnace from the combustion process.

Decanting floors in kraft recovery boilers are known for collecting and directing molten smelt from the black liquor combustion process to discharge openings in the boiler walls. The water tubes forming the floor are cooled by the circulation of water and/or a water/steam mixture through the tubes.

The floors of many known decanting recovery furnaces are essentially flat across the entire surface. Flat floors are subject to minor humping of the tubes, causing domes which form in the upper surfaces of the floor tubes. Steam can become trapped in these humps or domes (steam blanketing) which can cause the tubes to overheat and fail. More particularly, steam blanketing is where steam bubbles are not effectively entrained in the water moving through the tubes. In the flat floor tubes adjacent the furnace sidewalls, the heat input to the tubes may be lower. Since flow through the tubes is by natural circulation, the low heat input to these tubes results in lower fluid velocities and poor circulation in the tubes, which in turn causes steam blanketing.

Currently, the only known method for correcting this defect in flat floor furnaces is to replace the entire tube floor with a new floor. The new floor is sloped to increase the tolerance for heat absorption at lower fluid velocities and to permit venting of the minor humps which would otherwise trap steam and lead to tube overheat and failure. However, replacing the entire furnace floor is both time consuming and expensive, and a cost-effective solution would be welcomed by industry.

SUMMARY OF THE INVENTION

One aspect of the present invention is to provide a method for upgrading a recovery boiler furnace floor without replacing the entire floor.

Another aspect of the present invention is to provide a method and furnace floor for preventing burst tubes which can be implemented relatively inexpensively and efficiently as compared to known solutions.

Accordingly, in improved floor for a recovery boiler furnace having a flat floor has a number of replacement tubes in the floor immediately adjacent each of the sidewalls of the furnace oriented at an oblique angle to horizontal.

In a first embodiment of the invention, immediately adjacent each of the sidewalls, the ends of the replacement tubes at each of the front and back walls are above the remainder of the tubes forming the flat floor and angled to slope downwardly towards a center of the furnace to the level of the tubes forming the flat floor. At the center of the floor, the other ends of the tubes are joined to a central header below the tube floor. The sloped tubes may have a central flat portion adjacent the center of the floor. The radius of curvature of the connection between the flat tube section ends and the central header may be varied to improve fluid flow through the connection, and to join up with the existing flat floor tubes.

In a second embodiment, the ends of the replacement tubes at one of the furnace front and rear walls then are connected to a collection header and are lower than the remainder of the tubes forming the flat floor. The other ends of the replacement tubes at the opposite furnace wall are level with or higher than the remainder of the tubes in the floor. The replacement tubes may be substantially straight along their length. The collection header may be positioned below either the front or back wall of the furnace.

In a method of improving circulation in the floor tubes of a flat floor furnace, several floor tubes immediately adjacent the sidewalls in a flat floor furnace are removed. A series of curved replacement tubes adjacent to the side walls positioned such that the tubes are oriented at an oblique angle to horizontal are connected to the front and back walls of the furnace.

The improved floor design of the invention helps reduce the occurrence of steam bubbles being trapped in humped areas in the furnace floor tubes or forming a steam blanket by improving the fluid flow through the tubes adjacent the sidewalls of the recovery boiler furnace.

The various features of novelty which characterize the invention are pointed out with particularity in the claims annexed to and forming a part of this disclosure. For a better understanding of the invention, its operating advantages and specific benefits attained by its uses, reference is made to the accompanying drawings and descriptive matter in which a preferred embodiment of the invention is illustrated.

DESCRIPTION OF THE PREFERRED EMBODIMENTS

Figure 1:
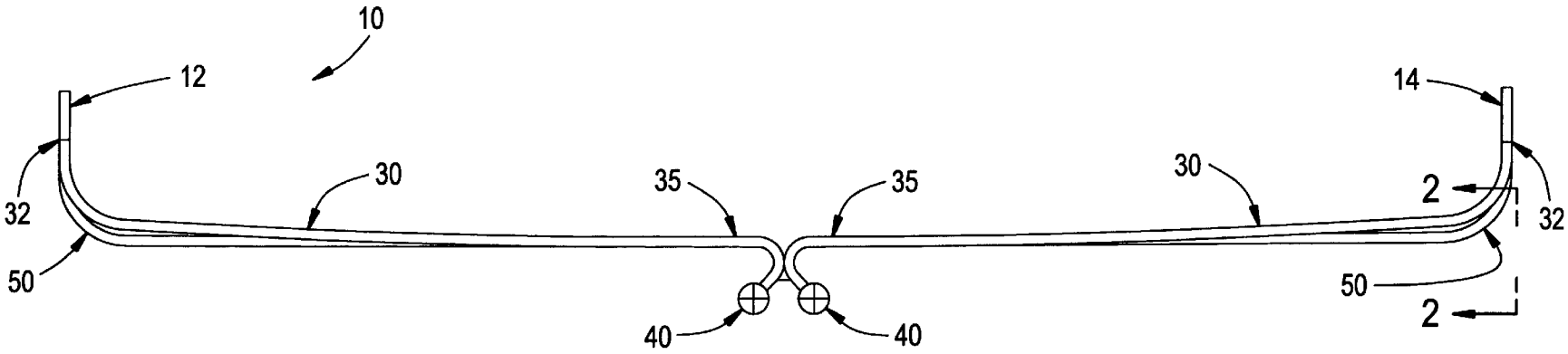
FIG. 1 is a side elevational view of a first embodiment of an improved replacement furnace floor of the invention.

Referring now to the drawings, in which like reference numerals are used to refer to the same or functionally similar elements, FIG. 1 shows the lower portion 10 of a recovery boiler furnace having front wall 12, back wall 14 and flat floor 50. Front and back walls 12, 14 are water tube walls. Floor 50 is also comprised of a plurality of water tubes.

Adjacent the sidewalls on either side of flat floor 50, a series of water tubes 30 are sloped downwardly from the front and back walls 12, 14 toward the center of the furnace lower portion 10. The sloped water tubes 30 are joined to central headers 40. The upper ends of sloped water tubes 30 are connected to the front and back furnace walls at weld points 32.

Figure 3:
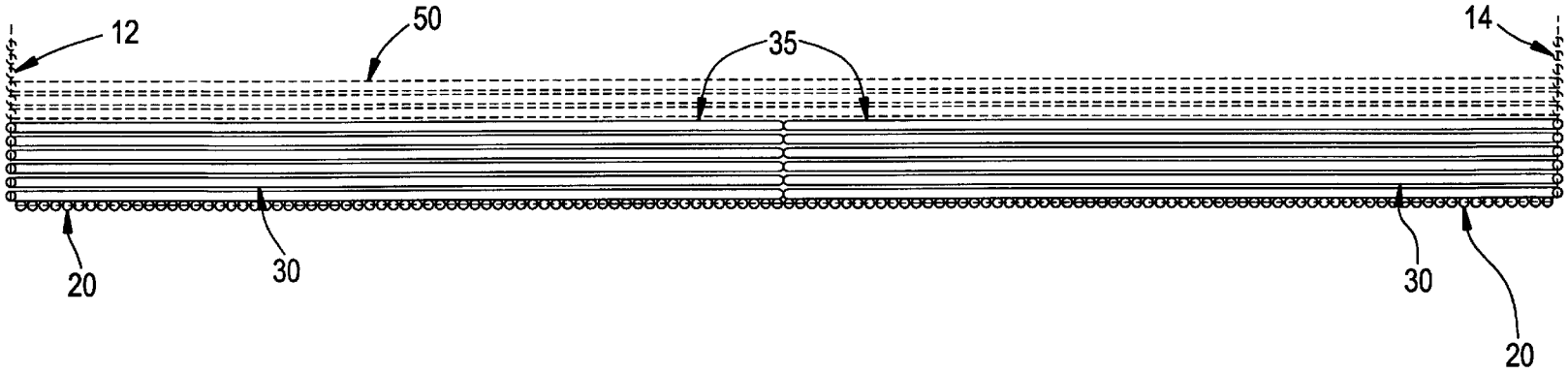
FIG. 3 is a top plan view of a portion of the furnace floor shown in FIG. 1.
Figure 2:
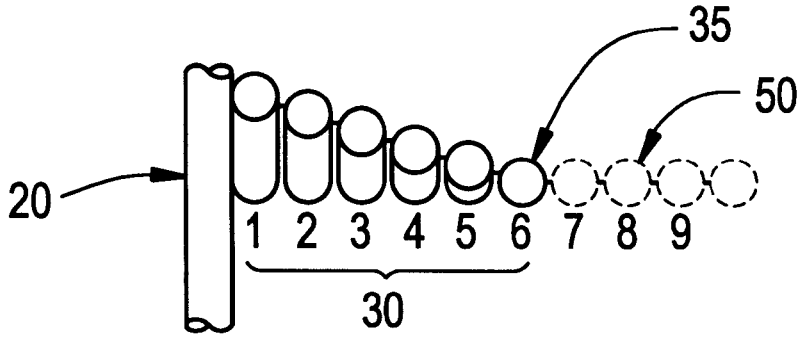
FIG. 2 is an end elevational view of a floor tube arrangement for the furnace floor shown in FIG. 1, viewed in the direction of arrows 2—2.

As seen in FIGS. 2 and 3, sloped tubes 30 and flat floor 50 form a continuous surface, with gaps between each tube sealed. Sloped tubes 30 are angled more relative to horizontal immediately adjacent a sidewall 20 and the angle gradually decreases the farther the tube 30 is located from the sidewall 20 until the tubes are consistent and level with the flat floor 50. Between 3 and 9 water tubes 30 could be used for the sloped tubes 30. Preferably, six water tubes 30 are used for the sloped tubes 30, with the sixth tube 30 being relatively flat and unsloped. (See FIG. 2). The angles which the tubes 30 make with the horizontal plane are between 0° and 10°.

The sloped water tubes 30 may be 2½ or 3 inch outer diameter, internally ribbed tubes, with Inconel® 625 outside cladding to enhance their resistance to the furnace environment.

By providing the sloped tubes 30 adjacent the sidewalls 20, the path which the water and/or steam takes through these tubes 30 is more gradual and upwards adjacent the front and back walls 12, 14. The gradual, upward path improves the fluid flow through the sloped tubes 30, which would otherwise be hampered by poor thermal conduction near the sidewalls 20 of the furnace 10. As a result, the effect of humping and steam blanketing is greatly reduced.

The sloped tubes 30 are easily installed in existing flat floor recovery boiler furnaces, as only 12 tubes total need to be replaced and welded back to the flat floor 50. Preferably, the existing tubes are removed adjacent each sidewall 20 between the front and back walls 12, 14. Then, the new sloped tube sections are connected to the front and back walls 12, 14 with welds 32 at the appropriate heights on the front and back walls 12, 14 for the desired angle the tube will make to horizontal, gradually decreasing to the level of the existing flat floor 50. The other ends of the sloped tubes 30 are connected to the central headers 40.

In the embodiment of FIGS. 1–4, the sloped tubes 30 have a flat portion, generally designated 35, at the center of the lower portion 10 of the recovery boiler furnace. The flat portion 35 of the sloped tubes 30 from both the front wall 12 and back wall 14 meet at this location, and a seal must be provided at this point.

Figure 4:
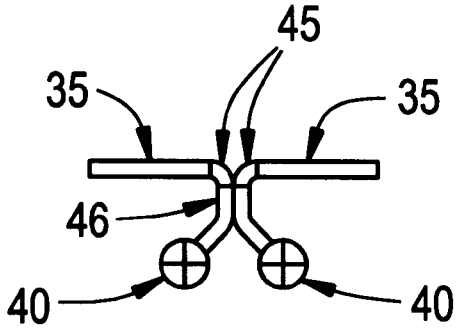
FIG. 4 is a side elevational view of an alternate connection to a central headers for the floor tubes.

FIG. 4 shows an alternate configuration for the flat portion 35 connection to the central headers 40 which improves the seal between the sloped tube 30, flat portion 35 and the floor 50 at the central header 40. An elbow section 45 connects the flat portion 35 of section 30 to a bent tube 46 connected to the central headers 40. The elbow section 45 bends about 90° and preferably has a radius of 5½ inches.

Figure 7:
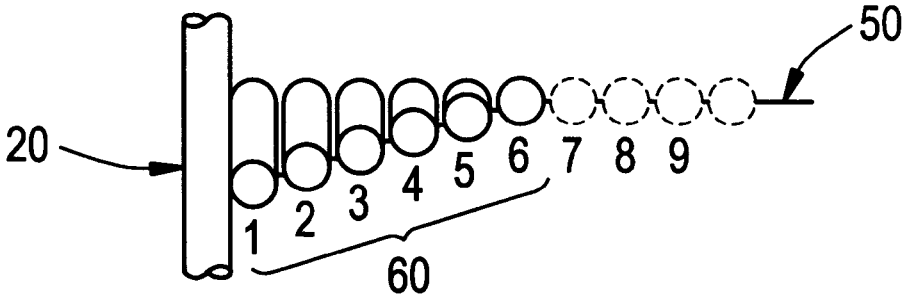
FIG. 7 is an end elevational view of a floor tube arrangement for the furnace floor of FIG. 5.
Figure 5:
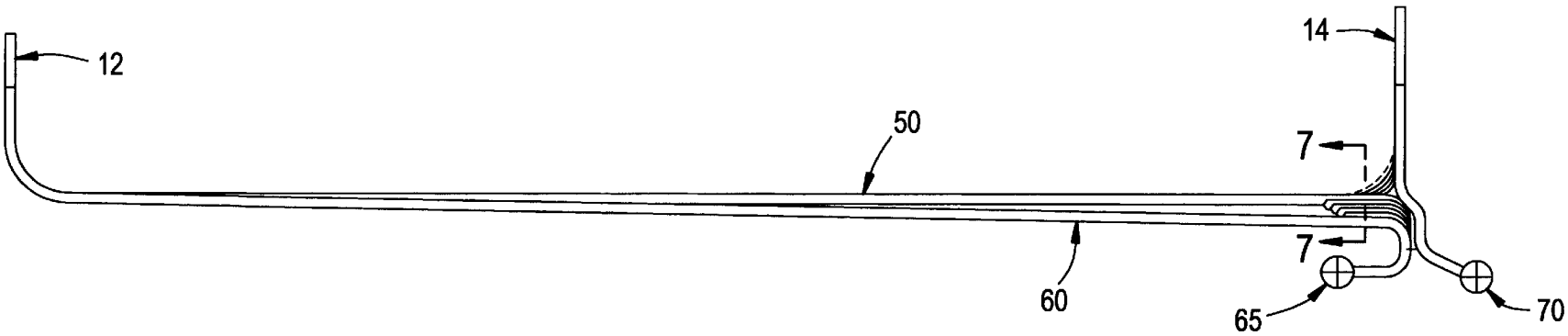
FIG. 5 is a side elevational view of a second embodiment of an improved replacement furnace floor.
Figure 6:
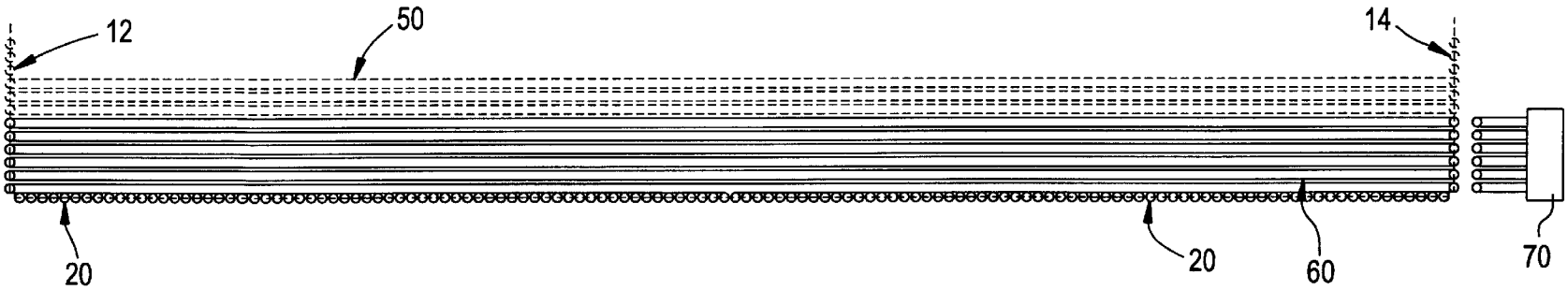
FIG. 6 is a top plan view of a portion of the furnace floor shown in FIG. 5.

In a second embodiment of the improved furnace floor, shown in FIGS. 5–7, sloped tubes 60 adjacent the sidewalls 20 are only provided at one of the front or back walls 12, 14. A supply header 65 is provided at the end wall 12 or 14 where a lowest portion of the sloped tubes 60 are located.

As seen in FIG. 5, the sloped tubes 60 are provided at the back wall 14. In this embodiment, the sloped tubes 60 are oriented at angles below the level of the flat floor 50, as seen in FIG. 7. Preferably six tubes 60 would be used; between 3 and 9 tubes 60 could be used as well. The tubes 60 are oriented at angles of between 0° and 10° below the horizontal, with the greatest slope being found in the tube 60 closest to the sidewall 20 and the angle each tube 60 makes decreasing to 0° where they are again even with the flat floor 50. The ends of the sloped tubes 60 adjacent the front wall 12 are level with the flat floor 50. The gaps between the tubes are sealed, membraned, as above to form a continuous floor 50.

The floor of a flat floored furnace would be renovated according to this embodiment in a manner similar to that described above, except that a new header 65 must be installed at the end wall 12 or 14 where the sloped tubes 60 are located. Another new header 70 also is required. Header 70 feeds those rear wall tubes adjacent to the sidewall 20 that were previously fed with the floor.

While specific embodiments of the invention have been shown and described in detail to illustrate the application of the principles of the invention, those skilled in the art will appreciate that changes may be made in the form of the invention covered by the following claims without departing from such principles. For example, the present invention may be applied to new construction involving kraft recovery boilers, or to the replacement, repair, or reconstruction of existing kraft recovery boilers. In some embodiments of the invention, certain features of the invention may sometimes be used to advantage without a corresponding use of the other features. Accordingly, all such changes and embodiments properly fall within the scope and equivalents of the following claims.

We claim:

1. An improved furnace floor for use in recovery boiler furnaces having a pair of side tube walls, a front tube wall, a back tube wall and horizontal tubes between the front and back tube walls forming a floor to reduce the occurrence of steam blanketing and humping in the horizontal floor tubes, the furnace floor comprising:

at least three sloped tubes connected between at least one of the front and back tube walls and a header, the at least three sloped tubes located immediately adjacent one sidewall and oriented such that the angle each successive tube of the at least three sloped tubes after the first sloped tube nearest the sidewall forms with the horizontal tube floor decreases until the sloped tubes are horizontal, the at least three sloped tubes and the horizontal floor tubes forming a continuous membrane furnace floor between the sidewalls and front and back tube walls.

2. The improved furnace floor according to claim 1, wherein the at least three tubes comprises six tubes.

3. The improved furnace floor according to claim 2, further comprising an additional six sloped tubes immediately adjacent the opposite sidewall oriented such that the angle each successive tube of the additional six sloped tubes forms with the horizontal tube floor decreases until the sloped tubes are horizontal.

4. The improved furnace floor according to claim 1, further comprising at least three additional sloped tubes immediately adjacent the opposite sidewall oriented such that the angle each successive tube of the at least three additional sloped tubes forms with the horizontal tube floor decreases until the sloped tubes are horizontal.

5. The improved furnace floor according to claim 1, wherein the header is positioned near the center of the furnace floor between the front and back walls.

6. The improved furnace floor according to claim 5, further comprising a second group of at least three sloped tubes are positioned immediately adjacent the sidewall between the header and the other of the front and back tube walls.

7. The improved furnace floor according to claim 6, wherein the at least three sloped tubes comprises six tubes and the second group also comprises six tubes.

8. The improved furnace floor according to claim 1, wherein ends of the tubes at one of the front and back tube wall are level with or higher than a remainder of the horizontal floor tubes, and other ends of the tubes at an opposite one of the front and back tube wall as lower than the remainder of the horizontal floor tubes.

9. The improved furnace floor according to claim 8, further comprising a collection header at the ends of the tubes which are lower than the remainder of the horizontal floor tubes.

* * * * *